United States Patent [19]

Krämer

[11] Patent Number: 4,981,378

[45] Date of Patent: Jan. 1, 1991

[54] APPARATUS FOR PRINTING A STRIP

[76] Inventor: Wilfried Krämer, Kurländer Allee 21, D-1000 Berlin 19, Fed. Rep. of Germany

[21] Appl. No.: 291,560

[22] Filed: Dec. 29, 1988

[51] Int. Cl.[5] ..... B41J 33/44; B41J 19/28; B41J 1/46

[52] U.S. Cl. ..... 400/621; 400/221; 400/572; 101/110; 101/288; 101/93.18

[58] Field of Search ..... 400/621, 221, 219.3, 400/593, 572; 101/110, 288, 93.18, 93.11; 74/116, 118

[56] References Cited

U.S. PATENT DOCUMENTS

| | | | |
|---|---|---|---|
| 2,393,294 | 1/1946 | Crane | 74/116 |
| 2,521,211 | 9/1950 | Ganz | 74/116 |
| 3,526,189 | 9/1970 | Allen | 101/288 |
| 3,782,279 | 1/1974 | Carboni, Jr. et al. | 101/288 |
| 4,113,544 | 9/1978 | Sato | 101/288 |
| 4,127,064 | 11/1978 | Pettis, Jr. | 401/93.18 |
| 4,167,345 | 9/1979 | Englund et al. | 400/593 |
| 4,234,260 | 11/1980 | Kunita et al. | 400/219.3 |
| 4,240,345 | 12/1980 | Kyogoku | 101/110 |
| 4,283,149 | 8/1981 | Rethemeier | 400/621 |
| 4,294,553 | 10/1981 | Wuthrich | 400/221 |
| 4,544,293 | 10/1985 | Cranston et al. | 400/320 |
| 4,706,562 | 11/1987 | Hori | 101/93.11 |
| 4,723,486 | 2/1988 | LeMeur et al. | 101/110 |
| 4,797,016 | 1/1989 | Lahr | 400/225 |

*Primary Examiner*—Edgar S. Burr
*Assistant Examiner*—John S. Hilten
*Attorney, Agent, or Firm*—Weintraub, DuRoss & Brady

[57] ABSTRACT

The invention relates to an apparatus for printing stamps, which are cut from a strip (2) drawn from a roll (1). The apparatus has an adjustable printer and a common drive for the non-jerky advance of the strip and for operating a cutting mechanism. An eccentrically mounted, reciprocating clutch (17) is provided for the advance and engages with a strip-diving roller (56) operates the cutting mechanism and is connected to a movable blade (22) thereof. The pawl is eccentrically fixed to a rotary driven disk (18), which also carriers a cam (58) for controlling the lever. The printer has adjustable type wheels (24), which are rotatable by a common shaft (31) via friction clutches and for each type wheel there is an independently controllable pawl (33) for arresting the type wheel in a predetermined position.

14 Claims, 4 Drawing Sheets

FIG 2A
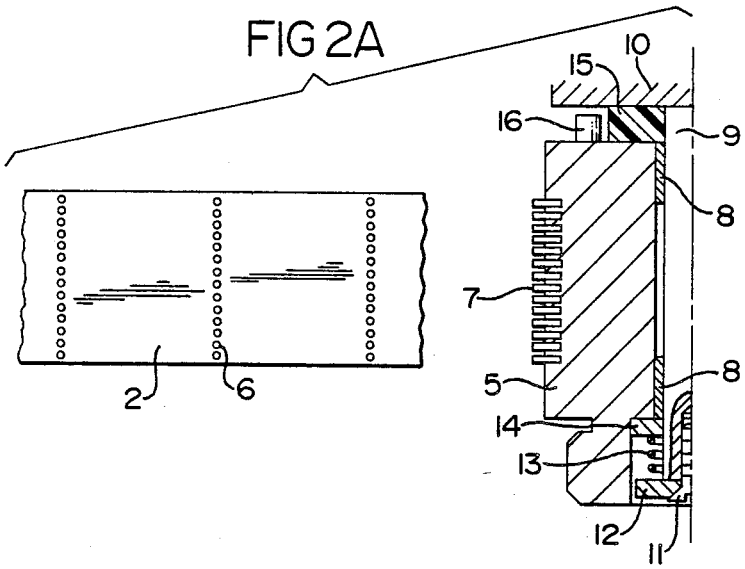
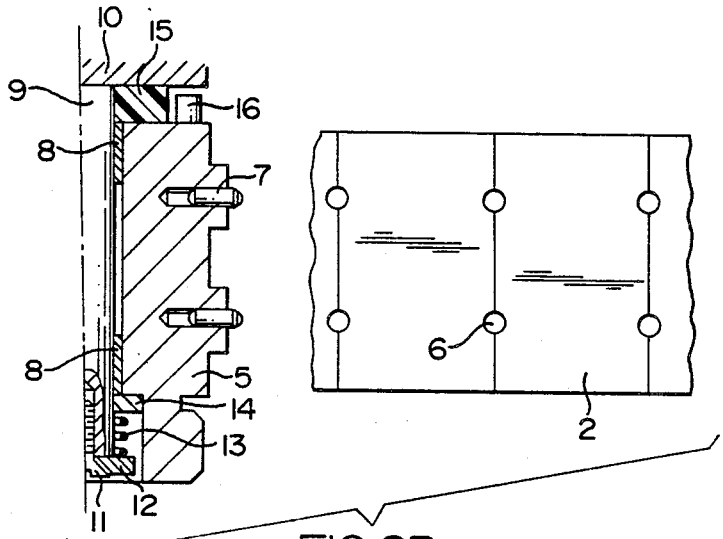
FIG 2B

FIG. 3A
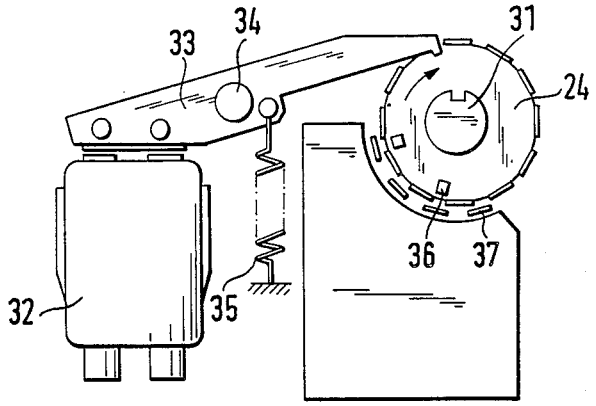
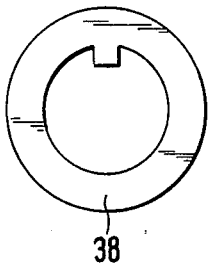
FIG. 3C
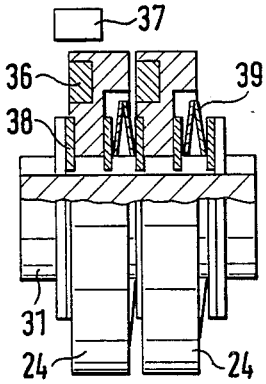
FIG. 3B
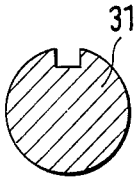
FIG. 3D

APPARATUS FOR PRINTING A STRIP

The invention relates to an apparatus for printing stamps, which are cut from a strip drawn from a reel.

BACKGROUND OF THE INVENTION

The problem occurs in connection with such apparatuses, that the stepwise pulling forward of the strip must be performed as rapidly as possible and as a result jerky advance movements occur, which lead to sudden tensile stress changes in the strips. There is consequently a high risk of the strip tearing, particularly if it has sprocket holes.

Apparatuses for printing stamps generally have printers with adjustable type wheels. The type wheels are normally adjusted by ratchet or pawl drives, which rotate the type wheels stepwise until they have reached the desired position. However, this adjusting or setting process is time-consuming and requires a complicated setting mechanism.

In addition, these printers conventionally operate with an inking ribbon reversibly driven between two spools. The construction of the reversible drive and its switching over on reaching a ribbon end are relatively complicated.

The problem of the present invention is to provide an apparatus for printing stamps, in which the strips are moved in non-jerky manner despite faster advance movements, so that a risk of tearing is substantially prevented. In addition, the apparatus has a rapidly and reliable settable printer. Finally, the reversing mechanism of the inking ribbon drive is simply constructed and operates in a reliable manner.

SUMMARY OF THE INVENTION

According to the invention this problem is solved in that a common drive is provided for the non-jerky advance of the strip and for the operation of a cutting mechanism, which has an eccentrically mounted, reciprocating pawl, which engages with a strip-driving roller for the stepwise rotation thereof and which also has a cam-controlled lever, which is connected with a movable knife of the cutting mechanism. Fore this purpose, preferably a rotatably driven disk is provided, on which the pawl is eccentrically mounted and which carries a cam for the control of the lever. The printer had adjustable knife of the cutting mechanism. For this purpose, a common shaft via friction clutches and for each type wheel is provided an independently controllable pawl for arresting type wheel in a position. The printer is also provided with an inking ribbon wound onto two spools or reels and advantageously a switch controlled by the winding state of the ribbon is provided for determining the rotation direction of the drive rotating the spools. For reversing the drive, it is possible to provide a gear connected to the drive and displaceably mounted in an elongated slot and which as a function of the rotation direction of the drive can be engaged with one or other of the two spools.

The invention is described in greater detail hereinafter relative to a preferred embodiment and the attached drawings, wherein:

BRIEF DESCRIPTION OF THE DRAWINGS

FIG. 2A is a partial top cross-sectional view of a first embodiment of the roller bringing about the forward movement of the strip;

FIG. 2B is a partial cross-sectional view of a second embodiment of the roller showing an alternative strip which may be used with the present invention.

FIG. 3 shows the setting mechanism for the printer. FIG. 3*a* is a side plan view of a type wheel and positioning pawl. FIG. 3*b* is a front plan view, partially in cross-section of this type wheels. FIG. 3*c* is a plan view of a clutch disk, and FIG. 3*d* is a cross sectional view of the type wheel shaft.

DETAILED DESCRIPTION OF THE PREFERRED EMBODIMENT

Figure 1:
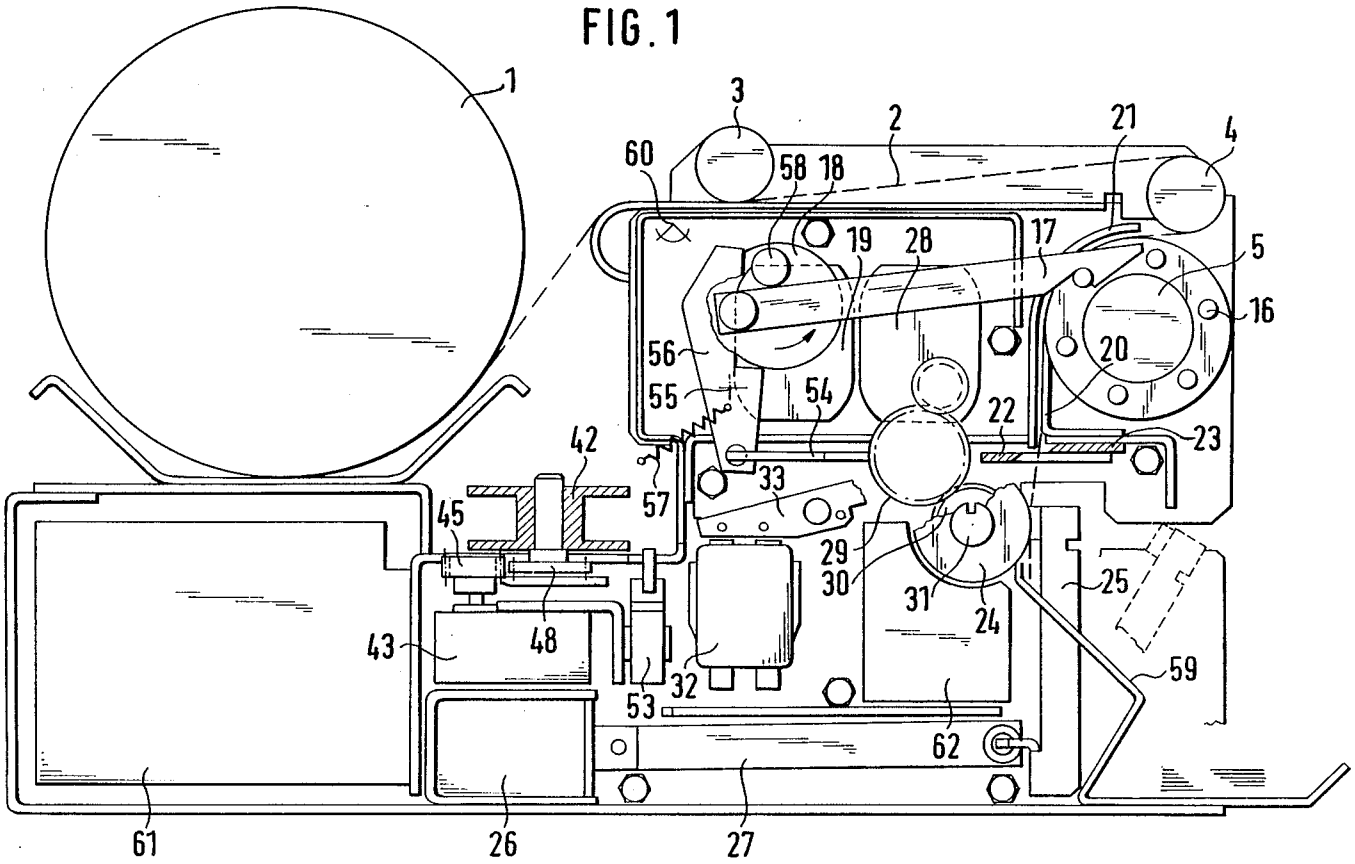
FIG. 1 is a diagrammatic representation of the overall apparatus in side view and without the surrounding casing.

Referring to FIGS. 1–4 a strip 2 is drawn stepwise from a preprint roll 1 comprising a wound-up paper strip. The advanced free end of the stip 2 is then printed and cut off. The length of the cut off stamp corresponds to the particular advance of the stip. The stamp can be used as a postage stamp, ticket or the like.

By means of guide pulleys 3,4, the strip 2 passes to a pin roller or wheel 5, which is shown in greater detail in FIG. 2. Strip 2 contains sprocket holes 6 and the pin wheel 5 has strip guide pins 7 projecting out of its cylindrical circumferential surface and which engage in the sprocket holes 6. Thus, on rotating the pin wheel 5, the strip 2 is advanced by a corresponding amount and is drawn from the preprint roll 1. Different strips 2 are shown to the right and left of the pin wheel 5 in FIG. 2. On the facing side in each case is shown how the pin wheel 5 is constructed, if either the right-hand or left-hand strip 2 is used. The arrangements shown on the left and right-hand sides of FIG. 2 are illustrative of alternate embodiments of the pin wheel 5 that could be used for printing different materials.

The pin wheel 5 is rotatably mounted on bearings 8 on a fixed shaft 9. Shaft 9 is anchored in a wall 10. By means of a screw 11 screwed into the shaft 9, the pin wheel 5 is pressed by means of a pressure disk 12, a compression spring 13 and a butting disk 14 in resilient manner against a brake disk 15 engaging with the wall 10. Thus, pin wheel 5 can be rotated only on overcoming an adjustable torque of shaft 9.

The pin wheel 5 carries on its end face and with the same radial spacing from the rotation axis, several identically spaced pins drive 16, which can be engaged with a ratchet or drive pawl 17, which is at one end eccentrically and rotatably attached to a motive disk 18, whilst its other end rests freely on one of the drive pins 16. The motive disk 18 is rotated in the direction of the arrow by a motor 19. In the represented position, the motive disk 18 is rotated 180° with respect to the starting position in which the apparatus is waiting for an externally given instruction for supplying a printed stamp. When this instruction is given, the motive disk 18 is rotated in the direction of the arrow out of its starting position, where the fulcrum or support point of the drive pawl 17 is closest to the pin wheel 5 and, as is shown in FIG. 1, the drive pawl 17 which is engaged behind a pin 16 drives the pin wheel 5 and correspondingly advances the strip 2. On rotating the motive disk 18 by 180°, the pin wheel 5 is driven by one spacing of the drive pins 16. On further rotation of the motive disk 18 from the represented position back into the starting position, the engagement between the drive pawl 17 and pin 16 is removed and the bevelled leading edge of the drive pawl 17 slides over the following drive pin 16, until the nose located at the end of said leading edge, on reaching the starting position, slides over said drive pin 16 and the drive pawl 17 engages behind it, so that, if the motive disk 18 is turned out of the starting position again for a further advance of the strip 2, the pin wheel 5 is advanced once again by one spacing of the drive pins 16. The described pawl drive has the advantage that each movement of the pin wheel 5 is gradually phased in and out because of the relationship of the motive disk 18 and the drive pawl 17 as described herein and shown in FIG. 1. Thus the movement of the pin wheel 5 does not take place in a jerky manner as in the prior art devices and instead uniformly increases in accordance with the path of a sine curve until a maximum speed is reached and then uniformly decreases again. Although in this way a high conveying speed for the strip 2 is obtained, said movement is completely free from jerks, so that no excessively high tensile streeses occur in strip 2, so that there is virtually no tearing risk.

From the pin wheel 5, the strip 2 passes between two guide plates 20,21, as well as two cutting blades 22,23, to the printer, which substantially comprises adjustable type wheels 24, a printing hammer 25 and an inking ribbon not shown in FIG. 1. In the embodiment of FIG. 1, the printing hammer 25 just strikes against the type wheels 24, so that the interposed front portion of strip 2 is printed with the aid of the inking ribbon. Thus, FIG. 1 shows the apparatus in the printing position. Printing hammer 25 is operated by a printing magnet 26 by means of an articulate tie rod 27. The inoperative position of the printing hammer 25 is shown in broken line form.

The individual type wheels 24 are set or adjusted by means of motor 28, whose output shaft is connected by means of gears 29,30 to a shaft 31, as well as for each type wheel 24 a positioning pawl or ratchet magnet 32 with a positioning pawl or ratchet 33 operable by the latter. FIG. 3 shows the setting mechanism in greater detail. Each type wheel 24 is circumstantially provided with a number of notches corresponding to the number of printing types. Any one of said notches can engage the positioning pawl 33, so that the type wheel 24 with the associated printing type is arrested in a desired printing position. The positioning pawl 33 is pivotable about an axis 34 and is drawn by a spring 35 against the type wheel 24. Counter to the tension of spring 35, by energizing the pawl magnet 32, the positioning pawl 33 can be disengaged from the type wheel 24. Magnets 36 in a predetermined arrangement are fixed to each type wheel 24 and each type wheel 24 is surrounded by several fixed Hall elements 37 cooperating with the magnets 36. The instantaneous position of the type wheels 24 can at all times be determined from the output signals of the Hall elements 37.

Shaft 31 contains a groove 76 which engages the outwardly direction lugs 75 of several coupling or clutch disks 38 mounted on shaft 31, so that same are connected in non-rotary manner to shaft 31. It will therefore be appreciated that the clutch disk 38 are held in a fixed angular relationship to the shaft 31 by the lugs 75 in the groove 76. The coupling disks 38 are pressed by cup springs 39 against the lateral faces of type wheels 24, so that friction grip occurs.

At the start of the setting process the pawl magnets 32 are energized, so that the position pawls 33 release the associated type wheels 24 and the shaft 31 is rotated by the motor 28. The individual type wheels 24 are driven by means of the coupling disks 38. The Hall elements 37 determine the state of the type wheels 24 and if a type wheel has reached an intended printing position, the associated pawl magnet 32 is deenergized, so that the corresponding positioning pawl 33 engages in type wheel 24 and arrests the same. The further rotating coupling disks 38 then slide on the lateral faces of the arrested type wheels 24 and in this way each wheel 24 can be individually brought into any desired printing position. When the setting process is ended, the motor 28 is stopped again.

Figure 4:
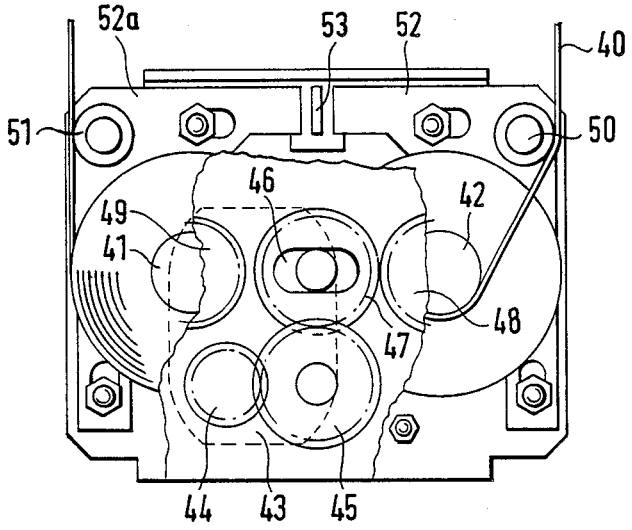
FIG. 4 is a top view partially cut away, of the driving and reversing means for the inking ribbon.

The inking ribbon 40 (FIG. 4) used for printing purposes is wound onto two reels or spools 41,42 and is guided between them by the printer. It is wound during operation onto one spool and is unwound from the other. Following the complete unwinding therefrom, the conveying direction is reversed, so that the emply spool is now used for winding on the other spool for unwinding. FIG. 4 shows the driving and reversing means for the spools. A rotating direction-reversible motor 43 drives a gear 45 via an output shaft 44. Said gear is in permanent engagement with a gear 47 mounted in an elongated slot 46. The position of gear 47 is determined by the rotation direction of gear 45. If the latter rotates clockwise, then the axis of the gear 47 moves to the right in slot 46 and gear 47 engages with a gear 48 of spool 42. If gear 45 rotates counterclockwise, then the axis of gear 47 moves to the left in slot 46 and gear 47 engages with a gear 49 of spool 41. Thus, the rotation direction of motor 43 makes it possible to determine which of the two spools 41 or 42 is being driven, driving always taking place in the winding-on direction. The unwinding from the in each case other spool is brought about by the tensile stress in the inking ribbon produced during winding on, unwinding being decelerated by a friction clutch, so that the ribbon 40 is always tensioned.

The inking ribbon 40 is moved past two switching or control rolls 50,51 each of which is fixed on a switching or control lever **52, 52*a*. As a result of the latter a switch 53 is operated and its switching state once again determines the rotation direction of motor 43**.

If e.g. inking ribbon 40 is wound onto spool 41 and wound off spool 42, then the switching levers **52,52*a* are located in their right-hand position. Inking ribbon 40 presses from the left against switching roll 51, so that the switching lever 52*a* is held in this position. Only when the inking ribbon 40 has been almost completely wound onto spool 41, is the diameter of the thus formed spool sufficiently large for the ribbon 40 to no longer be in contact with switching roll 51 and in fact moves past the same at such a distance that the switching lever 52*a* is released for a movement into its left-handed position. This movement is brought about by the inking ribbon 40 by means of switching roll 50, but only when the inking ribbon has been completely unwound from spool 42. The ends of the inking ribbon 40 are fixed to the particular spool 41 or 42, so that when complete unwinding has taken place, the inking ribbon movement is suddently stopped and a relatively high tensile stress occurs in the ribbon and is adequate to reverse the rotation direction of motor 43, i.e. gear 47 is released from gear 49 and engages with gear 48, so that winding now takes place onto spool 42 and off spool 41. When the entire inking ribbon 40** has passed through the printer, the drive is again reversed in described manner.

The cutting mechanism for separating the printed portion from the strip 2 comprises the movable cutting blade 22 and the fixed cutting blade 23. Cutting blade 22 is connected by means of a rod 54 to a lever 56 pivotally mounted for rotation about an axis 55. A spring 57 pivots lever 56 clockwise, so that the cutting blade 22 is retracted via rod 54 and frees the path for strip 2. The motive disk 18 carries a pinlike cam 58 which, on rotating the disk 18, strikes against the upper end of lever 56 and pivots same counterclockwise, so that via rod 54 the cutting blade 22 is advanced and in conjunction with cutting blade 23 separates the lower portion from the strip 2. Cam 58 is so arranged on the motive disk 18 so the following the printing process cutting blade 22 is put into action and returns to the represented starting position when the motive disk 18 has again reached the inoperative position.

The cut off stamps drop onto a stacking plate 59, which is constructed in such a way that the stamps sliding down from it are superimposed in oriented manner.

A light barrier 60 determines the end of strip 2 and triggers a suitable signalling device and the operating sequence is then interrupted.

A casing 61 contains the main parts and a control mechanism for the overall apparatus. Individual control plates 62 associated with the type wheels 24 contains the Hall elements 37 and the evaluation logic connected thereto.

The represented apparatus has a simple, compact construction. The individual functional units are constructed in a modular manner, can easily be mounted on a base plate and can also be easily replaced.

Having thus, described the invention, what is claimed is:

1. An apparatus for printing a strip, comprising:

(a) a roller having two end faces;

(b) a printer which is adjustable to print a plurality of different imprints;

(c) a cutting mechanism comprising a moveable blade; and (d) a common drive mechanism for both operating the cutting mechanism and advancing the strip, the drive mechanism comprising:

(1) a rotatable motive disk having an eccentrically mounted cam surface thereon for controlling the cutting mechanism;

(2) a drive pawl mounted eccentrically on the motive disk to allow for reciprocal motion thereof, the drive pawl being engageable with the roller for stepwise rotation of the roller to advance the strip; and (3) a cam-controlled lever and a rod which is operatively connected to said lever, said lever being mounted for pivotal movement thereof and said rod being mounted for slidable movement thereof, said rod being connected to the moveable blade of the cutting mechanism, and said cam surface being operable to contact said lever to pivot said lever and thus slidably move said rod and said blade to cut said strip.

2. The apparatus of claim 1 further comprising a plurality of drive pins disposed on one end face of the roller, the pins being engagable successively by the drive pawl to cause stepwise rotation of the roller.

3. The apparatus of claim 1, further comprising a plurality of strip guide pins on the roller disposed circumferentially for driving the strip.

4. The apparatus of claim 1, wherein the printer comprises:

(a) a plurality of adjustable type wheels;

(b) a rotatable shaft on which the type wheels are mounted;

(c) a plurality of friction clutches interposed the type wheels; and (d) an independently controllable positioning pawl for each type wheel for arresting the type wheel in a desired position.

5. The apparatus of claim 4, further comprising a plurality of Hall sensors for determining the position of each type wheel.

6. The apparatus of claim 4, wherein the friction clutches comprise clutch disks connected in a fixed angular relationship to the shaft, the clutch disks being resiliently pressed against the associated type wheels.

7. The apparatus of claim 1, further comprising:

(a) an inking ribbon for the printer;

(b) two rotatably mounted spools, each spool having an end of the ribbon attached thereto;

(c) a switch controlled by a winding state of the ribbon for determining a rotation direction of a drive rotating the spools; and (d) a drive for rotating the spools.

8. The apparatus of claim 7, further comprising an elongated slot formed therein and a gear displaceably mounted in the elongated slot and connected to the drive, the gear alternately engagable with one or the other of the two spools as a function of the rotation direction of the drive.

9. The apparatus of claim 8, wherein the switch can be actuated for reversing by the inking ribbon being completely wound onto one spool and wherein the reversing can be brought about by the tension produced in the ribbon in the case of complete unwinding from the other spool.

10. An apparatus for printing a strip, comprising:

(a) a strip advancing mechanism, the mechanism comprising means for advancing the strip in a substantially smooth and jerkless motion so as to avoid tearing of the strip, the advancing means comprising a rotatable motive disk, a drive pawl eccentrically mounted on the disk, and a cam surface eccentrically mounted on the disk;

(b) a rotatable shaft;

(c) a type wheel having a plurality of printing surfaces thereon, the type wheel being mounted on the shaft and rotatable therewith, the type wheel further having a plurality of notches formed in an exterior surface thereof;

(d) means for rotating the shaft;

(e) a positioning pawl for engaging a notch of the type wheel to prevent rotation thereof;

(f) a cutting mechanism having a moveable blade; and (g) a cam-controlled lever and a rod which is operatively connected to said lever, said lever being mounted for pivotal movement thereof and said rod being mounted for slidable movement thereof, said rod being connected to the moveable blade of the cutting mechanism, and said cam surface being operable to contact said lever to pivot said lever and thus slidably move said rod and said blade to cut said strip.

11. The apparatus of claim 10, further comprising means for sensing the position of the type wheel.

12. The apparatus of claim 11, wherein the means for sensing comprises a Hall sensor.

13. The appartus of claim 10, further comprising means for moving the positioning pawl into engagement with the type wheel.

14. The apparatus of claim 13, wherein the means for moving the pawl, comprises:

(a) an electromagnet disposed proximate the pawl, and (b) means for biasing the pawl toward the type wheel.

* * * * *